United States Patent [19]

Kimmell et al.

[11] 4,168,842

[45] Sep. 25, 1979

[54] TRUCK FOR A SKATEBOARD OR THE LIKE

[75] Inventors: Steve D. Kimmell, Granada Hills; Benjamin H. Stansbury, Jr., Beverly Hills; Brian Hills, Rolling Hills Estate, all of Calif.

[73] Assignee: Mattel, Inc., Hawthorne, Calif.

[21] Appl. No.: 866,494

[22] Filed: Jan. 3, 1978

[51] Int. Cl.[2] ..... A63C 17/04

[52] U.S. Cl. ..... 280/11.28; 280/87.04 A

[58] Field of Search ..... 280/87.04 A, 87.04 R, 280/11.28, 11.27, 11.19, 11.1 R, 11.1 BT

[56] References Cited

U.S. PATENT DOCUMENTS

| | | | |
|---|---|---|---|
| 78,207 | 5/1868 | Henson | 280/11.27 |
| D. 157,734 | 3/1950 | Burton | 280/11.27 |
| 243,323 | 6/1881 | Sutton | 280/11.27 |
| 308,547 | 11/1884 | Arnold | 280/11.28 |
| 321,227 | 6/1885 | Lancaster | 280/11.28 |
| 329,581 | 11/1885 | Miller | 280/11.19 |
| 329,582 | 11/1885 | Miller | 280/11.28 |
| 329,583 | 11/1885 | Miller | 280/11.28 |
| 329,584 | 11/1885 | Miller | 280/11.28 |
| 329,845 | 11/1885 | Mundy | 280/11.28 |
| 352,743 | 11/1886 | Fenton | 280/11.27 |
| 2,341,576 | 2/1944 | Shye | 280/11.28 |
| 2,561,448 | 7/1951 | Murray | 280/11.28 |
| 3,355,184 | 11/1967 | Green | 280/11.19 |
| 3,649,038 | 3/1972 | Huckenbeck | 280/11.28 |
| 4,061,350 | 12/1977 | Schmidt, Jr. et al. | 280/87.04 A |
| 4,071,256 | 1/1978 | Kimmell | 280/11.28 |

*Primary Examiner*—David M. Mitchell

*Attorney, Agent, or Firm*—John G. Mesaros; Ronald M. Goldman; Robert W. Mulcahy

[57] ABSTRACT

A truck for a skateboard or roller skate, the truck being a unitary assembly having a structure for securing to a member for supporting a rider, the member being in the form of a skateboard or soleplate of a roller skate, the structure being generally rigid and downwardly depending from the undersurface of the rider supporting member with a lower edge lying in a plane diagonally disposed relative to the undersurface. The structure includes an axle receiving portion for receiving an axle therein with the axle being normally generally parallel to the rider supporting member and generally perpendicular to the longitudinal center line thereto. The axle receiving portion in one embodiment is connected to the lower edge. In the other embodiment a generally flexible web interconnects the lower edge with an upper edge of the axle receiving portion with the two edges in generally parallel relation, with the web in a plane normally perpendicular to the undersurface of the supporting member, the shifting of the weight of the rider deflecting the axle receiving portion relative to the rider supporting member to provide steering.

16 Claims, 12 Drawing Figures

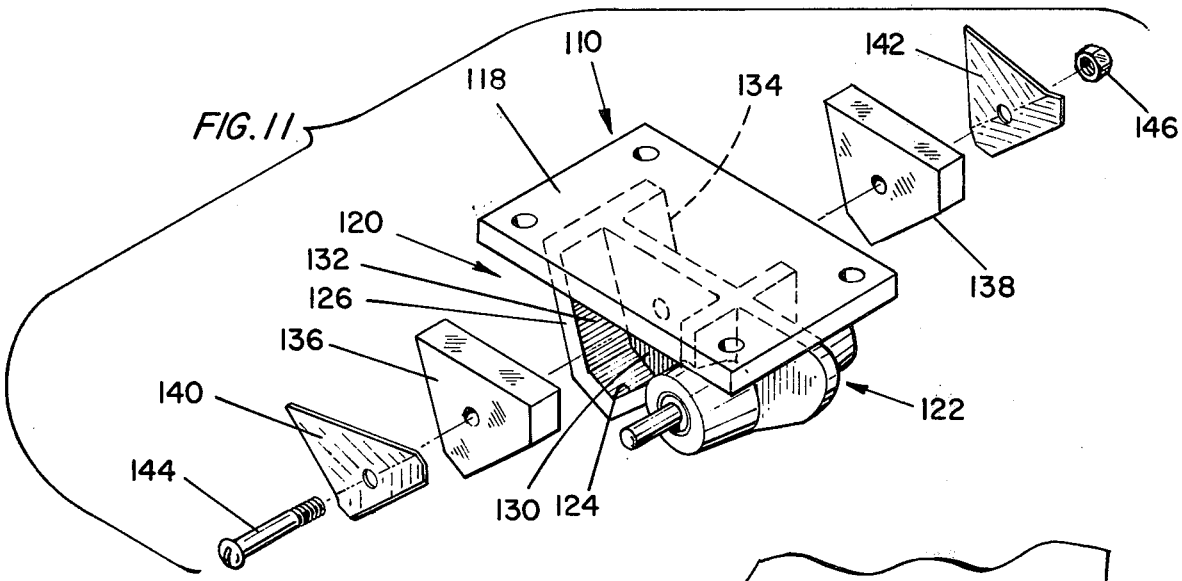
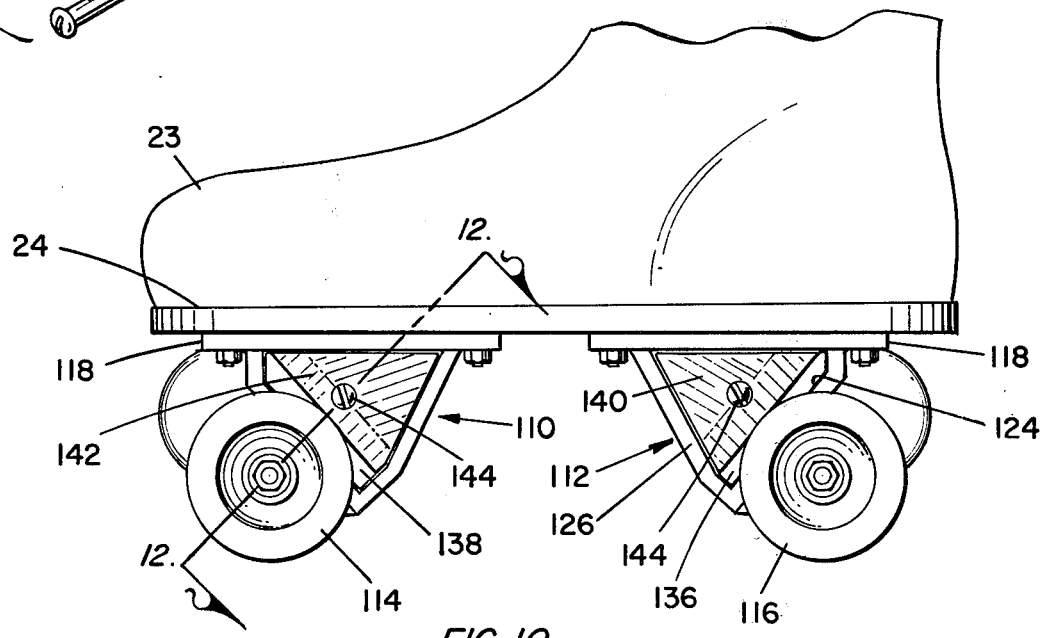
FIG. 10
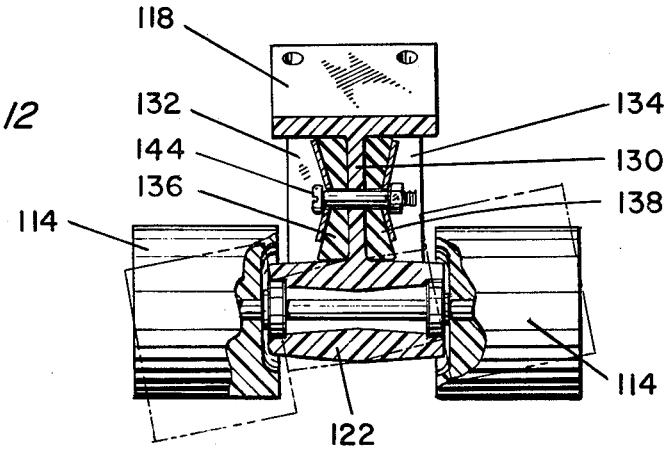

TRUCK FOR A SKATEBOARD OR THE LIKE

BACKGROUND OF THE INVENTION

The background of the invention will be discussed in two parts:

1. Field of the Invention

This invention relates to skateboards and roller skates, and more particularly to trucks for such devices.

2. Description of the Prior Art

In prior art conventional skateboards or roller skates, a truck is employed to support a wheel and axle assembly to provide "steering", the steering being provided by the shifting of the weight of the rider to one side or the other, with the two trucks being mounted in mirror image relation as viewed from the side, to permit the two pairs of wheels to turn simultaneously in opposite directions resulting in both pairs of wheels defining an arc of a curve. A conventional truck arrangement for a skateboard is shown in U.S. Pat. No. 3,945,655 entitled "Brake for a Skateboard and the Like", issued Mar. 23, 1976 to Banks, et al. The trucks and skateboard shown in that device illustrate the current trucks in which two axes are formed, these being a steering axis and a rebound axis. A first member having the axle and wheel assembly coupled adjacent one end thereof is pivotally secured, usually by means of a ball and socket arrangement at the other end of the member, to the underside of a mounting plate, this member having a flange with an enlarged opening therein for receiving on either side thereof annular cushions suitably retained by washers on opposite surface with an adjustable bolt assembly passing therethrough to define the "rebound axis". In the conventional configuration, the two axes can be envisioned as a V-shaped configuration with the axle of the wheels offset from the apex of the "V" on the member defining the steering axis. Normally the axles of each pair of wheels are parallel and "outboard" of each other, that is, the axles are positioned closer to the opposite ends of the rider supporting member or skateboard, with the "rebound" cushions in facing relation, thus permitting the steering of each individual truck to be accomplished simultaneously in opposite directions in response to the shifting of the weight of the rider.

In such conventional truck arrangements, the parts are generally die cast, or sometimes machined, require many parts, and in general are somewhat complicated both to manufacture and assemble. Furthermore, by the utilization of a separate steering axis and rebound axis in the V-shaped configuration, steering constraints are placed on the system.

In U.S. Pat. Application, Ser. No. 739,079, filed Nov. 5, 1976, entitled "Truck for Skateboard or the Like" by Steven Donald Kimmell, such application being assigned to Mattel, Inc., the assignee of the instant application, the prior art skateboard truck is shown and described in contrast to the skateboard truck of such application. In the skateboard truck of the Kimmell application, only one axis is provided, this being a steering axis, with a trunnion rotating about this axis, the trunnion having a member coupled for rotation therewith to urge against cushion means circumferentially positioned about the axis within a housing.

It is an object of the present invention to provide a new and improved rider supporting device such as a skateboard or the like.

It is a further object of this invention to provide a new and improved truck for use with a skateboard or roller skate or the like.

It is a further object of this invention to provide a new and improved truck having flexible hinge means for providing steering.

It is still another object of this invention to provide a new and improved truck having a hinge portion integral with the truck, deflection of the hinge portion resulting in steering.

SUMMARY OF THE INVENTION

The foregoing and other objects of the invention are accomplished by providing a device for supporting a rider, such device including a roller skate or skateboard or the like having a truck member attachable to or integral with a rider supporting member such as the soleplate of a roller skate or the board of the skateboard. The truck includes a structure in depending relation to the rider supporting member with the alignment thereof being in general alighnment with the longitudinal center line of the rider supporting member, the depending structure having a lower edge diagonally disposed relative to the plane of the rider supporting member. A portion of the truck is configured for receiving bearing members and an axle, the axle being in a plane normally parallel to the plane of the rider supporting member and extending in a direction generally perpendicular to the longitudinal center line of the rider supporting member. In a first embodiment, the axle receiving portion is provided with an upper edge, the two edges being interconnected by a generally flexible hinge means or web with the two edges in generally parallel relation, the web lying in a plane generally extending through the longitudinal center line of the rider supporting member. The plane of the web may be offset to one side or the other of the center line to provide a steering bias in a given direction for the wheels of the truck resulting from the differential in spacing, or the lever arm, between the vertical center line of the web and a vertical line extending through the longitudinal center line which, will generally correspond to the center of gravity or center of weight placed on the rider supporting member.

In a second embodiment the axle receiving portion is connected directly to the lower edge of the structure which is provided with an integrally molded plate portion normally generally perpendicular to the plane of the lower edge, effectively providing hinge means between the lower edge and the plate portion, the lower edge along with the axle receiving portion being deflected relative to the plate portion upon shifting of weight of the rider to provide steering.

The depending structure and the axle receiving portion are generally rigid and the truck is molded in one piece which includes the depending structure, the axle receiving portion, the plate portion, and also the interconnecting web of the first embodiment, the one piece construction being preferably formed from an elastomeric or polypropylene plastic material. In the first embodiment, cushioning means may be provided by insertion of a cushion member between flange portions of the opposing edges, the amount of cushioning overall being determined by the dimension, density and volume of the cushioning member as well as the thickness and height of the interconnecting web. In the second embodiment, a pair of cushion members is positioned in pockets on opposite sides of the plate portion for coacting against the lower edge, the opposing cushion members being retained by bolt and washer means, the tightening or loosening of which vary the cushioning effect.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 10 is a side elevational view of a roller skate utilizing a second embodiment of the truck according to the invention;

FIG. 11 is an exploded perspective view of the embodiment of the truck illustrated in FIG. 10; and FIG. 12 is a cross-sectional view, taken generally along line 12—12 of FIG. 10, illustrating in dotted lines the deflection of the axle receiving portion.

DESCRIPTION OF THE PREFERRED EMBODIMENT

Figure 1:
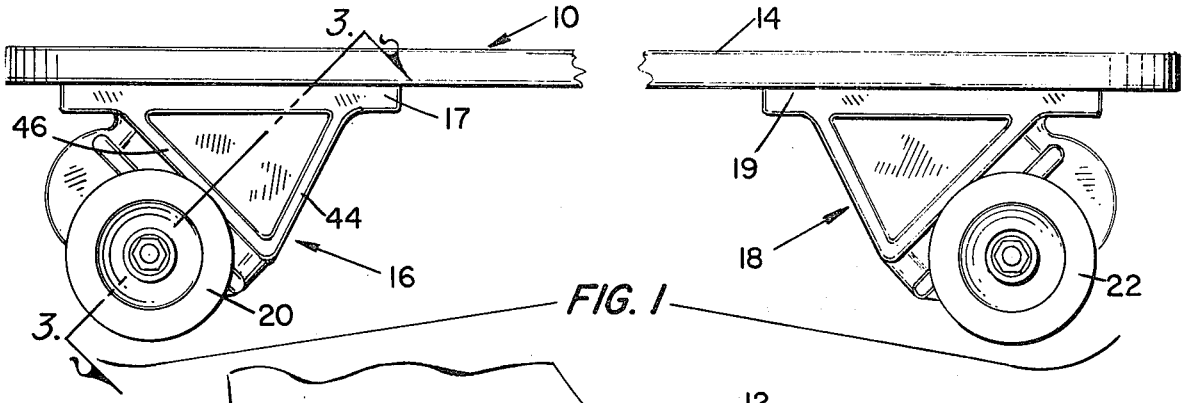
FIG. 1 is a side elevational view of a skateboard (partially broken away) utilizing the truck according to the invention.
Figure 2:
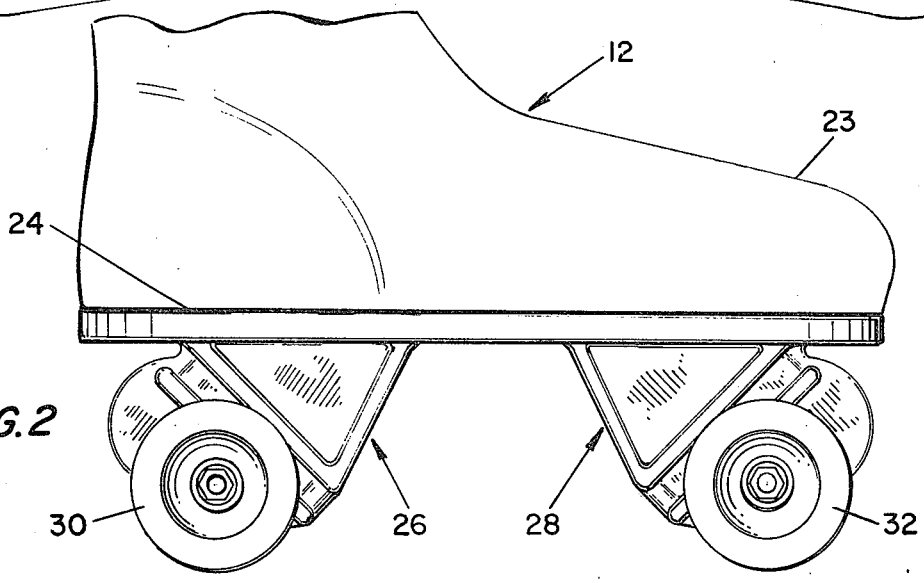
FIG. 2 is a side elevational view of a roller skate utilizing the truck according to the invention.

Referring now to the drawings, in FIGS. 1 and 2, two devices are illustrated utilizing the truck according to the invention, these being a skateboard generally designated 10, shown in FIG. 1 and a roller skate, generally designated 12, shown in FIG. 2. In each of these structures, as will hereinafter be discussed, the trucks are substantially identical in structure and mounting for each of the devices 10 and 12, although variations in the mounting or fastening means may result based on use with a skateboard 10 or use with a roller skate 12. Furthermore, the trucks may be formed integrally with the rider supporting member or may be formed with a mounting plate for securing to a separable rider supporting member.

Referring specifically to FIG. 1, the skateboard 10 includes a rider supporting member 14 which may be made of wood, metal or plastic. Secured in depending relation to the undersurface of the board 14 are trucks 16 and 18 which are substantially identically configured, although mounted to the board 14 in mirror image relation, as viewed in side elevation in FIG. 1. Each of the trucks 16 and 18 is provided with an enlarged mounting plate 17 and 19, respectively, for securing to the undersurface of the board 14 by any suitable fastening means such as screws or nuts and bolts or the like. The trucks 16 and 18 are in depending relation with the lower outer portions thereof having affixed thereto an assembly for supporting two pairs of wheels 20 and 22 (only one of each being shown). The axis of rotation of each of the wheels 20 and 22 is on a line normally parallel to the plane of the rider supporting member 14 and, of course, to the plane of the surface adapted to be engaged by the wheels 20 and 22, such surface ordinarily being a sidewalk, street pavement or the runways of skateboard parks. In the skateboard device 10, as will hereinafter be described, the trucks 16 and 18 are unitary assemblies which are secured to the rider supporting member 14, although, the trucks 16 and 18 may be molded integrally with the rider supporting member 14.

In FIG. 2, a roller skate device 12 is illustrated with a boot 23 having a rider foot supporting member or soleplate 24 secured to or integral with the boot 23. The soleplate 24 has integrally formed therewith truck members 26 and 28, each of which suitably supports rotatably mounted pairs of wheels 30 and 32 (only one of each being shown).

In each of the devices 10 and 12, the rider supporting members 14 and 24, respectively, have longitudinal center lines extending in a direction along the length of the rider supporting member and centrally disposed with respect to opposite edges, this longitudinal center line generally pointing in the intended direction of travel of the devices 10 and 12 with no shifting of the riders weight. This longitudinal center line generally corresponds to the position of the rider supporting member wherein, if the center of gravity or center of weight, or the force applied, to the rider supporting member is along a line normal to the plane of the rider supporting member and extends through this longitudinal center line, the rider supporting device will travel in a straight line with the axles of the two pairs of wheels being substantially parallel to each other. As will hereinafter be discussed, a shifting of weight of the rider to either side of the longitudinal center line will result in the plane of the rider supporting member being angularly disposed relative to the surface upon which the device is traveling thereby angularly disposing, or rotating, the axles of the wheel assemblies toward each other on the side of the weight shift thereby creating a turning movement along the arc of a curve.

Figure 3:
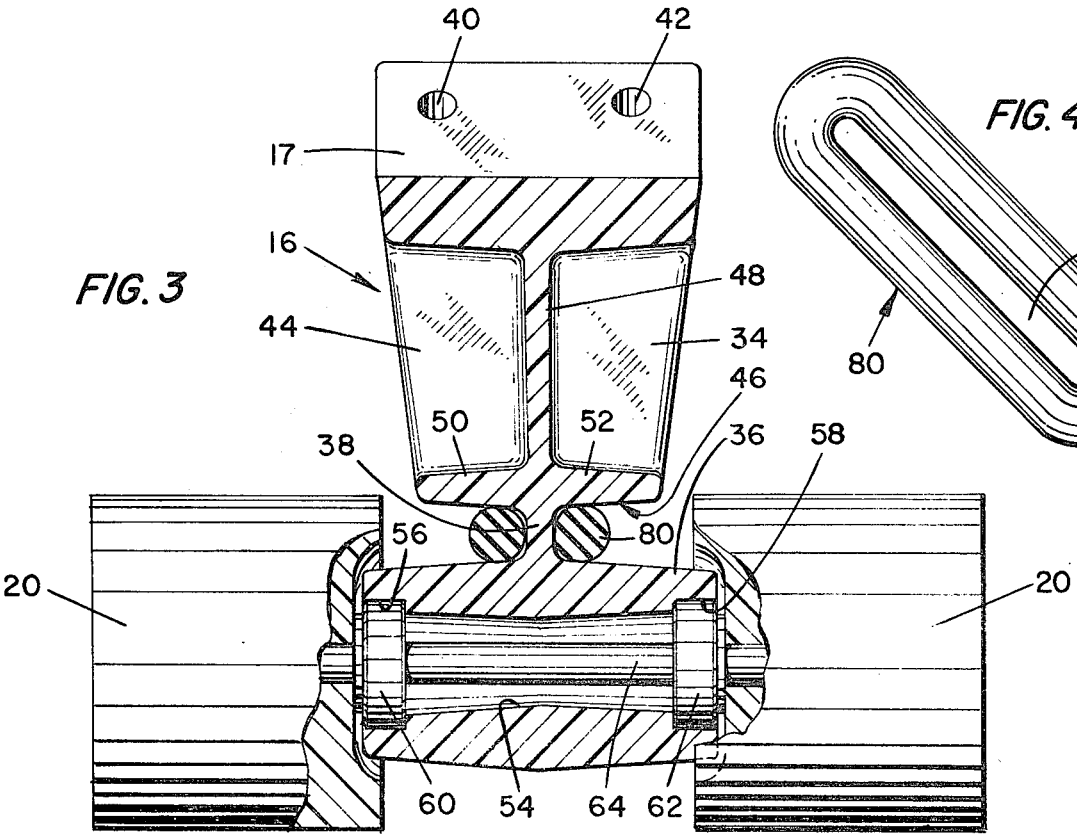
FIG. 3 is a cross-sectional view, partially broken away, taken generally along line 3—3 of FIG. 1, having a cushion member added thereto.

Referring now also to FIGS. 3–8, the details pertaining to the trucks will be described with reference to truck 16, it being understood that the description will apply equally to trucks 18, 26 and 28. In FIG. 3, the truck 16 is illustrated in partial cross section with the rider supporting member 14 removed for ease of illustration. Essentially, the truck 16 is composed of three portions, these being a supporting structure 34, an axle and bearing receiving portion 36, and a hinge means or interconnecting web 38. In the illustration of FIGS. 3–8, the truck 16 is shown as a unitary integral assembly molded in one part, and in the preferred form would be molded as such to provide a simple, economical, uncomplicated steering truck assembly. It is to be understood, however, that the truck may be molded in separate parts within the spirit and scope of the invention.

The structure 34 is a generally rigid structure having an upper planar surface or mounting plate 17 with apertures 40 and 42 formed therein adjacent one edge thereof for mounting to the rider supporting member or board 14. The mounting plate 17 is a relatively broad surface with a thickness sufficient to provide the required rigidity. The structure 34 in side elevation as seen in FIG. 1 is generally triangular with a peripherally extending reinforcing rim portion 44 defining a lower edge 46 which is angularly disposed relative to the plane of rider supporting member 14 of skateboard 10, this angle preferably being approximately 45 degrees to the plane of the surface of board 14 or mounting plate 17. Centrally disposed between opposite edges of rim portion 44 is an integrally molded reinforcing plate portion 48 extending in a plane normal to the plane of the surface of mounting plate 17 and centrally positioned relative to opposite long edges thereof, the plane of reinforcing plate portion 48 extending through the longitudinal center line of the rider supporting member 14 with the truck 16 assembled thereto. This plate portion 48 provides structural rigidity of the depending structure 34. As illustrated in FIG. 3, the lower edge 46 of truck 16 provides oppositely disposed flange portions 50 and 52 on opposite sides of plate portion 48, the flange portions 50 and 52 being substantially identically configured. In cross section, the structure 34 is I-shaped although it is to be understood that the structure 34 can be molded in the form of a block, if so desired.

The axle receiving portion 36 is a generally cylindrical member, the axis of which lies in a plane normally substantially parallel to the plane of the surface of mounting plate 17 (and similarly the plane of the rider supporting member 14) and extends in a direction perpendicular to a plane extending through the reinforcing plate portion 48. The axle receiving portion 36 is provided with an axially extending opening 54 which is enlarged at opposite ends 56 and 58 thereof for frictionally receiving bearing members 60 and 62, respectively. Extending through opening 54 and rotatably supported by bearing members 60 and 62 is an axle 64 having suitably secured to the opposite ends thereof the wheels 20, the wheels 20 being made of any conventional substance adapted for engaging a surface upon which the device or skateboard 10 is to be used.

Figure 5:
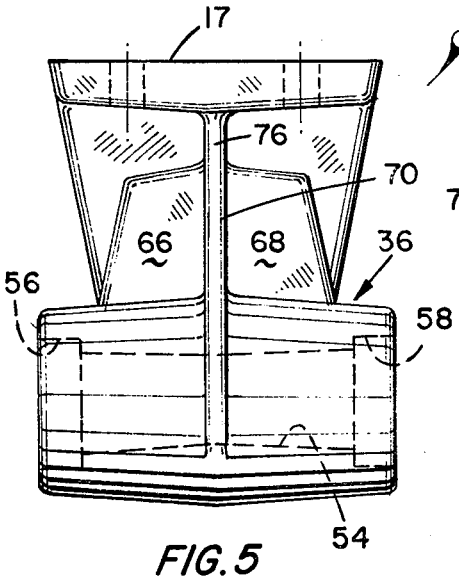
FIG. 5 is a rear view of the truck, without the board and wheels, as viewed generally along line 5—3 of FIG. 1.
Figure 7:
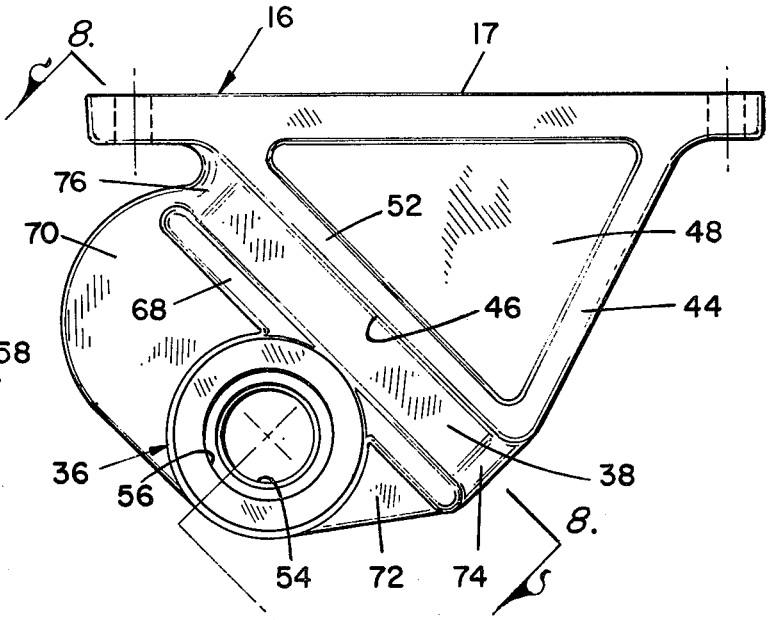
FIG. 7 is a side view of the truck of FIG. 5.
Figure 6:
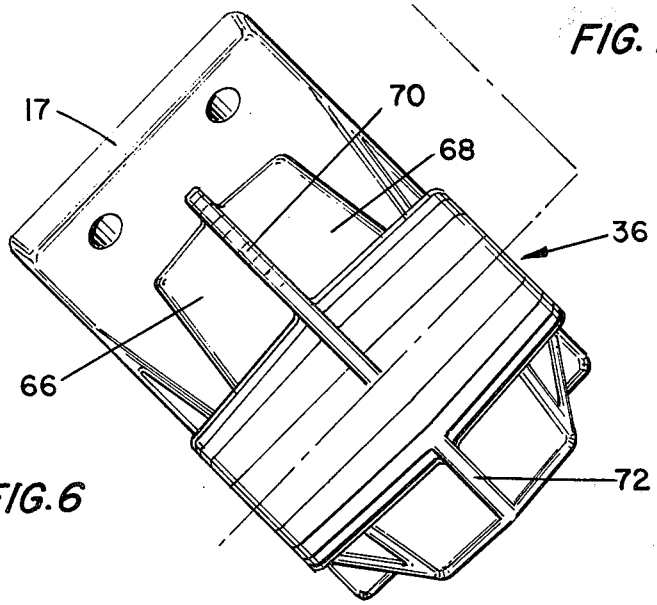
FIG. 6 is a bottom plan view of the truck of FIG. 5.

As better illustrated in FIGS. 5–7, the axle receiving portion 36 is provided with an edge defined by oppositely disposed reinforcing flange sections 66 and 68 which extend in a common plane tangential to the periphery of the cylindrical portion of axle receiving portion 36 with reinforcing rib means 70 and 72, of plate-type configuration, extending in a plane bisecting the plane of flanges 66 and 68, the plane of the rib means likewise bisecting the length of the cylindrical portion of axle receiving portion 36. The plane of the rib means 70 and 72 is generally coextensive with the plane of the reinforcing plate portion 48 with the interconnecting hinge means or web 38 lying in the same plane.

Figure 8:
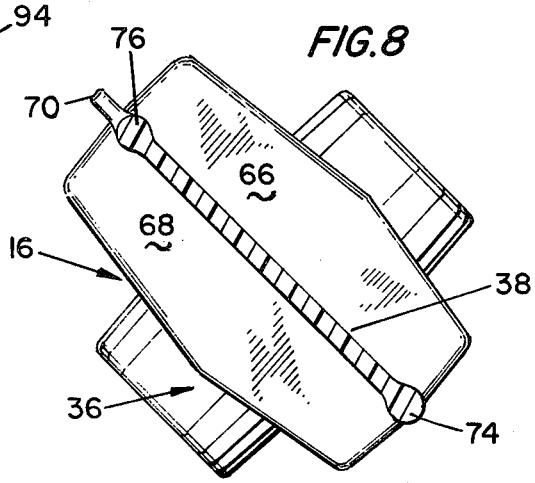
FIG. 8 is a cross-sectional view taken generally along line 8—8 of FIG. 7.

As best illustrated in FIGS. 1, 2 and 7, the web portion 38 is a generally elongate web which interconnects the structure 34 with the axle receiving portion 36 with the plane of the lower edge 46 of structure 34 in generally parallel relation to the edge of axle receiving portion 36 defined by a plane extending through flanges 66 and 68 thereof. The flange pair 50 and 52 of structure 34 and the flange pair 66 and 68 of axle receiving portion 36 are thick walled to provide a generally rigid structure on opposite edges of the web 38 to thereby limit deflection of the truck 16 to a localized zone coextensive with the hinge means or web 38. With the truck 16 being molded as an integral unit, that is, with structure 34, axle receiving portion 36, and web 38 being formed of the same material at the same time, and utilizing a plastic material capable of repeated flexing without failure, a low cost truck is achieved. Such a material may include, for example, an elastomeric material or polypropylene plastic material. As better illustrated in FIG. 8, the web 38 has a leading edge 74 thereof and the trailing edge 76 thereof enlarged in cross-sectional view to provide additional structural reinforcement for the edges, the edges being the most likely areas to fail. The amount of deflection or resilience provided by the web 38 varies according to several factors, these being, for example, the thickness of the web 38, the height of web 38, that is, the distance between opposing pairs of flanges, the material selected for construction of the web 38, as well as any cross-sectional configurations such as the enlarging of the thickness adjacent opposite edges 74 and 76, for example. As shown in FIG. 8, the edges 74 and 76 have enlarged circular cross sections of a diameter larger than the thickness of the web 38 in which the opposing surfaces thereof are generally parallel.

Figure 4:
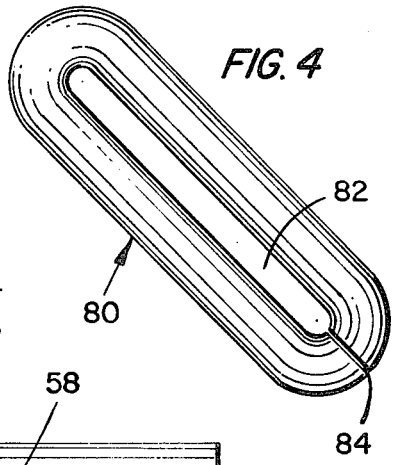
FIG. 4 is a plan view of the cushion member illustrated in FIG. 3.

Referring to FIG. 7, it can be seen that the center of the axle receiving opening 54 is spaced downwardly from the plane of the flange portions 66 and 68 of the axle receiving portion 36, with its center being intermediate opposite ends of flange 68. This positioning in conjunction with the diagonal disposition of web 38 relative to the ground or to the plane of the mounting plate 17 generates steering action as the structure 34 is rotated about the longitudinal center line of the hinge means or web 38 relative to the axle receiving portion 36 as the weight of the rider is shifted on the rider supporting member. Viewing FIG. 3 with the truck 16 mounted to a rider supporting member 14, for example, as the weight of the rider is shifted toward the left, as viewed in FIG. 3, flange portion 50 of structure 34 is urged downwardly toward flange 66 of the axle receiving portion 36. That is, a structure 34 pivots counterclockwise about hinge means or web 38 relative to the axle receiving portion 36. As this action occurs, due to the diagonal displacement of the hinge means or web 38, the left wheel 20, as viewed in FIG. 3, is urged rearwardly while the right wheel 20 is urged in a forward direction due to rotation of axle 64 about a hypothetical vertical axis during this weight shifting, thereby causing the wheels 20 to be aligned in the direction of the weight shift. Similarly, if the weight is shifted in a direction to rotate structure 34 clockwise relative to axle receiving portion 36 of truck 16, the direction of travel of wheel 20 relative to the longitudinal center line of the rider supporting member 14 will move in the direction of the weight shift to effect a turning maneuver. This relative rotation of the two parts about the hinge means or web 38 is resisted by the natural resilience or "memory" of the material used for the truck 16. As previously mentioned, the amount of this restoring force varies with the thickness and height of the web 38 as well as the material used and in an ideal configuration, the restoring force should be selected according to the weight of the rider. However, in normal manufacturing, to effect economies, a special cross-sectional configuration for each rider is not possible, and variations in the weight of the rider, or the intended usage of the truck 16 on a roller skate 12 or a skateboard 10, can be accommodated by providing cushioning means. In FIG. 3, interposed between the plane of flanges 50 and 52 and the plane of flanges 66 and 68, there is depicted in cross section a cushion member generally designated 80 (see FIG. 4) which is a generally ovate ring member having a central opening 82 configured for encircling the web 38 with minimal spacing therebetween, the cushion member 80 being split as at 84 through one end thereof to permit the opening of the cushion member 80 and positioning thereof about the web 38 intermediate the opposing flange portions of the structure 34 and bearing receiving portion 36. The cushioning member 80 as depicted in FIGS. 3 and 4, has a generally circular cross section with a diameter sufficient to fit within the gaps between opposite flanges. The cross-sectional configuration of cushion member 80 can take any convenient form consistent with the recesses on either side of web 38 with the selection of the material being, for example, of a dense rubber composition, with the amount of cushioning being variable by the amount of volume of cushioning material between the flanges as well as the density of the material and the type of material used for cushioning. In any event, referring to FIG. 3, with the cushion member 80 positioned as depicted, as the weight of the rider shifts to one side, for example, with flange portion 50 rotating toward the adjacent flange of axle receiving portion 36, the portion of the cushion member 80 therebetween will be compressed and simultaneously urged toward web 38 thereby eliminating the necessity or any supporting means for the cushion member 80 with the configuration of the cushion member shown in FIG. 4. The natural tendency of that portion of the cushion member 80 on the other side of web 38 will be to maintain it in position although no downward pressure is applied since, there would be no outward pressure on that portion which would dislodge it from between flange portion 52 and the opposing flange portion 68. As a consequence, a simple, yet effective, cushion member 80 in an ovate ring-like configuration having one end thereof split for fitting purposes, can be provided in conjunction with the unitary truck member 16 to provide additional cushioning as desired. Furthermore, by providing different cushion members 80 of different compressive strengths, the variation in weight of the rider or the variation in use of the truck 16 can be readily accomodated with the geometry of web 38 remaining constant.

Figure 9:
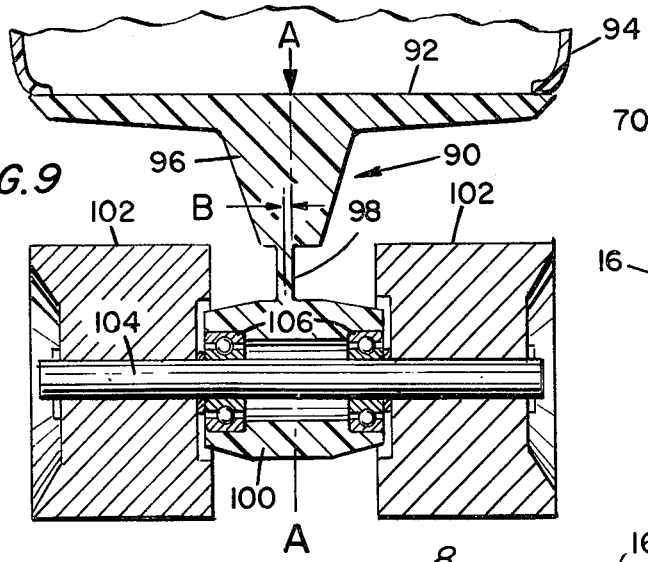
FIG. 9 is a cross-sectional view similar to FIG. 3; of a modified form of the truck according to the invention.

Referring now to FIG. 9, a modified embodiment of the truck 16 is illustrated and for purposes of clarity, different reference numerals will be employed. The truck 90 of FIG. 9 is shown as being attached to or integral with a soleplate 92 of a roller skate boot 94 with a generally centrally disposed downwardly depending structure 96 having an interconnecting web 98 securing the structure 96 to an axle receiving portion 100 having a pair of wheels 102 coupled for rotation about an axle 104 rotatably secured therein with appropriate bearing means 106. In all respects but one the truck 90 is substantially similar to the truck 16, the exception being that the web 98, while extending in a plane normally perpendicular to the plane of the soleplate 92, is offset to one side to provide a bias to the steering, that is, steering by means of shifting weight to one side of soleplate 92 is more easily accomplished than by shifting the weight to the other side of soleplate 92. By utilizing the vertical center line A—A as a reference, the center of weight of the foot within boot 94 placed on soleplate 92 would normally be on this line downwardly as depicted by the arrow on soleplate 92. The center line of the plane of the web 98 is displaced from this line to the left thereof as viewed in FIG. 9 by a distance designated B, this distance being the distance between a vertical line A—A and the vertical line extending through the center of the plane of web 98. As can be seen, the distance designated "B" provides a moment arm of turning with the weight in the normal position extending in the direction of the arrow, this moment being generally equal to the force along line A—A multiplied by the distance B, as a consequence of which the normal bias would tend to effect a turning to the right as viewed in FIG. 9. That is, the right-hand side of soleplate 92 would be urged downwardly more easily than the left side of soleplate 92. As the rider's weight shifts to the left side of soleplate 92, before a neutral position is reached, the moment arm must be overcome to effect a turning in that direction. The principle of biasing the truck 90 is similar to the toe-in requirement of an automobile for steering purposes to urge the wheels thereof in a straight line with minimum effort, and a modification depicted in FIG. 9 would normally apply to the use of the truck 90 in a roller skate device wherein the rider has each foot supported within a separate boot 94 with the bias of each boot being in opposite directions when both boots are viewed from the same end, that is, the heel or toe end. In roller skating, it is preferable that the ease of turning be in an outer direction, that is, with the easy steering of each boot being away from the other. As such, the diagramatic illustration of FIG. 9 would be a view of the right boot looking at the heel thereof with the left boot being a mirror image, thus providing a preferential ease of turning in the outer direction. The rider's weight would act on the center line of the system, that is, along line A—A with the hinge center line being offset inwardly from the boot center line. With the boots 94 and trucks 90 so configured, the normal skating maneuver of the roller skater would be effectuated, that is, sweeping movements alternately outwardly as each roller skates contacts the surface. It is to be understood that the web 98 like the web 38 of the truck 16 would extend diagonally to the rider supporting member 92 with the axle 104 being displaced in the same direction as the axle 64 of truck 16. The only difference between the truck 90 and the truck 16 is the offsetting of the web 98 relative to a hypothetical line through which the center of weight of the rider extends.

Similarly, as with truck 16, the truck 90 may be provided with flanges adjacent the lower edge of structure 96 with a spaced parallel flange integral with axle receiving portion 100 for receiving therebetween suitable cushioning means such as cushion member 80.

Although the hereinabove description has proceeded on the basis of a unitary truck wherein the interconnecting hinge means or web is integrally formed with the axle receiving portion 36 and structure 34, as previously set forth, the web can be formed integrally with either part with the other part being separable, or the web can be separate from both of the other parts with the other parts being configured for having the web secured or affixed thereto. In any event, the plane of the web would generally be positioned in a plane extending through the longitudinal center line of the rider supporting member (or slightly offset therefrom as shown in FIG. 9) with the web in side elevation being diagonally disposed relative to the plane of the supporting member with the axle receiving portion being configured for rotatably supporting an axle along a line extending perpendicular to the plane of the web, the axle normally being parallel to the plane of the supporting member.

Referring now to FIGS. 10–12, a second embodiment of a truck according to the invention is illustrated, and in FIG. 10 there is shown a roller skate 23 having a generally planar rider supporting member or soleplate 24 having secured to the undersurface thereof, in mirror image alignment, first and second truck members generally designated 110 and 112, the two truck members being substantially identical and the details pertaining to truck 110 will now be discussed in detail. As shown in FIG. 10, each of the trucks 110 and 112 is adapted to rotatably support a pair of wheels 114 (only one of which is shown) and 116 (only one of which is shown) respectively, the wheels 114 and 116 being adapted for gound engaging contact with a suitable surface. Although the trucks 110 and 112 are depicted as being fastened or secured to the undersurface of soleplate 24, it is to be understood that the trucks 110 and 112 may be molded integrally with the soleplate 24.

Referring specifically to FIG. 11, the truck 110 includes a mounting plate 118 with an integral depending structure portion generally designated 120 having integrally formed therewith an axle receiving portion generally designated 122. The depending structure 120 as viewed along section line 12—12 of FIG. 10, and as shown in FIG. 12, has a generally I-shaped cross section with the mounting plate 118 forming the upper cross bar portion and the lower edge 124 forming the lower cross bar portion, the lower edge 124 having a cylindrical axle receiving portion 122 coupled thereto in tangential relation. The depending structure 120 also includes a peripheral edge 126 continuously formed along with lower edge 124, lower edge 124 lying in a plane diagonally disposed relative to the plane of the mounting plate 118, the angle of inclination being approximately forty-five degrees with the circumference of the axle receiving portion 122 being positioned intermediate opposite ends of the lower edge 124. A reinforcing plate portion 130 interconnects the mounting plate 118 with the peripheral edge 126 and the lower edge 124, the plane of plate portion 130 being normally generally perpendicular to the plane of the mounting plate 118 and positioned intermediate opposite edges thereof to generally bisect the opening formed within the peripheral edge 126, the lower edge 124 and the mounting plate 118. On either side of plate portion 130, there are formed in the depending structure 120 recesses or pockets 132 and 134 which are generally trapezoidal in cross section and which receive therein identically configured cushion members 136 and 138 respectively, each of the members 136 and 138 having extending therethrough apertures in general alignment with a similarly configured aperture in plate portion 130. Similarly configured washer members 140 and 142 are positioned on either side of cushion members 136 and 138 with apertures in the washers through which extends suitable fastening means such as bolt 144 threadably receiving a nut 146 to maintain the washers and cushion members in position within the pocket 132 and 134.

As best illustrated in FIGS. 10 and 12 the edge of washers 140 and 142 parallel to the lower edge 124 is shortened to provide clearance during deflection of the axle receiving portion as shown in dotted lines in FIG. 12. Additionally, the washers 140 and 142 are V-shaped in cross section as best illustrated in FIG. 12 to thereby compress the cushion members 136 and 138 (which may be formed of rubber or the like) in a nonlinear fashion. The apexes of the washers are directed inwardly toward the plate portion 130 thereby resulting in compression of the cushion members adjacent the apertures to a greater degree than the compression adjacent the periphery of the cushion members 136 and 138, thereby directing the bias or cushioning force dowwardly toward the lower edge 124 as depicted in FIG. 12 and upwardly toward the bottom of mounting plate 118. The cushion members 136 and 138 are thus substantially captively restrained from deflection in the horizontal direction as depicted in FIG. 12 with the main compressive effect of the cushion members lying in a plane generally parallel to the plane of the plate portion 130 to thereby vary the force required for deflection of the axle receiving portion 122 relative to the plate portion 130 as likewise depicted in dotted lines in FIG. 12.

In operation, the truck of the embodiment illustrated in FIGS. 10–12 is similar to the truck of the first embodiment inasmuch as the axle receiving portion 122 deflects relative to the plane of the rider receiving member or soleplate 24 upon shifting of the weight of the rider. In the embodiment of FIGS. 10–12 the "hinging" effect is accomplished between the lower edge 124 relative to the normally generally perpendicular plate portion 130, it being understood that the truck 110 is formed in a single unit of an elastomeric or polypropylene material. The deflection of the lower edge 124 is resiliently resisted by means of the cushion members 136 and 138 having the adjacent edges thereof abutting against the lower edge 124 on opposite sides of plate portion 130.

Thus, it can be seen that the two embodiments illustrated and described hereinabove both utilize a generally rigid structure with an edge generally diagonally disposed relative to the surface, with the wheel and axle receiving portion being flexibly interconnected to the structure, in one embodiment by virtue of the plate portion and in the other embodiment by virtue of an interconnecting web which is generally an extension of the plate portion of the structure. In either event, a simple truck for a skateboard or roller skate is provided, preferably as a unitary assembly formed in one piece by molding or the like from an elastomeric or polypropylene material which can withstand repeated flexing. While there have been shown and described preferred embodiments, it is to be understood that various other adaptations and modifications may be made within the spirit and scope of the invention.

What is claimed is:

1. In a truck for use with a skateboard or like device, such device having a rider supporting member which is generally planar with a longitudinal center line, said truck comprising:

a generally rigid structure for securing to said member, said structure having a first flange means disposed within a plane intersecting the plane of said member along a transverse line;

a generally rigid portion configured for receiving an axle in normally parallel relation with the plane of said member, said portion having a second flange means normally parallel to said first flange means; and a generally flexible web interconnecting said first and second flange means for permitting deflection of said portion relative to said structure for pivoting the axle relative to said longitudinal center line in response to the shifting of the weight of the rider whereby to provide steering of said member, said structure said portion and said web are integrally formed to provide a unitary assembly.

2. The combination according to claim 1 wherein said truck further includes cushioning means adjacent opposite sides of said web interposed between said flange means for resisting deflection of said portion relative to said structure.

3. The combination according to claim 2 wherein said cushioning means is an elongate cushion member having an opening therein for generally encircling said web.

4. In a device for supporting a rider in a normally upright position relative to a surface, the combination comprising:

a member for supporting at least one foot of a rider, said member being generally planar and having a longitudinal center line;

a generally rigid structure in depending relation with said member, said structure having a lower flange disposed within a plane intersecting the plane of said member along a transverse line;

another member configured for receiving wheel and axle means with said axle in generally parallel relation to said surface, said another member being generally rigid and having a second flange generally parallel to said first flange; and a web integrally formed with said structure and said another member, said web flexibly interconnecting said flanges for pivoting said axle means relative to said longitudinal center line in response to tilting of said rider supporting member relative to a surface whereby to provide steering of said device.

5. The combination according to claim 4 wherein said web extends in a plane normally extending through said longitudinal center line.

6. The combination according to claim 5 wherein said structure, said another member and said web are formed of an elastomeric material.

7. The combination according to claim 6 further including cushion means between said flanges on opposite sides of said web whereby to resist deflection of said web.

8. The combination according to claim 7 wherein said cushion means is an elongate cushion member having an opening therein for generally encircling said web.

9. In a truck for a skateboard device or the like, such device having a generally planar member for supporting at least one foot of a rider in a normally upright position relative to a surface, the member being generally planar and having a longitudinal center line extending in the intended direction of travel, the combination comprising:

a structure having a generally planar portion for mounting said structure in depending relation to the undersurface of said member, said structure having a flange portion diagonally disposed relative to the plane of said mounting portion;

an axle means receiving member having a generally cylindrical portion for receiving an axle and having a flange portion generally tangential to the periphery of said cylindrical portion; and a web integrally formed with said structure and said axle means receiving member, said web interconnecting said flange portions with the flanges in generally parallel relation, said structure and said axle receiving member being generally rigid and rotatable relative to each other upon flexing of said web to permit pivoting of the axle relative to said longitudinal center line upon tilting of said member for steering the device.

10. In a roller skate, the combination comprising:

a soleplate having a longitudinal center line;

first and second truck means formed integrally with said soleplate, each of said truck means including:

a structure in depending relation to the undersurface of said soleplate, said structure being generally rigid and having a flange portion diagonally disposed relative to the plane, of the soleplate;

an axle receiving portion having a generally cylindrical portion for receiving an axle therethrough, the axis of said cylindrical portion being generally perpendicular to said longitudinal center line and normally generally parallel to said soleplate, said axle receiving portion including a flange portion generally tangential to and bisecting the periphery of said cylindrical portion;

an integral generally flexible web interconnecting said flange portions in generally parallel relation; and said first and second truck means being positioned on said soleplate with said flange portions of said first and second truck means in upwardly diverging relation to said soleplate for permitting the axles of said first and second truck means to be pivoted simultaneously in opposite directions relative to the supporting surface upon shifting of the weight of the rider relative to the longitudinal center line of the soleplate causing deflection of said web means.

11. The combination according to claim 10 wherein said web lies in a plane normally perpendicular to the plane of said soleplate.

12. The combination according to claim 11 wherein the plane of said web normally extends through said longitudinal center line.

13. The combination according to claim 11 wherein the plane of said web is normally offset from the longitudinal center line whereby to provide a steering bias.

14. In a device for supporting a rider in a normally upright position relative to a surface, the combination comprising:

a member for supporting at least one foot of a rider, said member being generally planar and having a longitudinal center line;

a generally rigid structure in depending relation with said member, said structure having a lower flange diagonally disposed relative to the plane of said member, said structure having a plate portion extending in a plane through said longitudinal center line normally generally perpendicular to the plane of said member and bisecting said flange;

another member configured for receiving wheel and axle means with said axle in generally parallel relation to said surface; and integrally formed means interconnecting said another member relative to said lower flange, for permitting deflection of said another member relative to said plate portion, the deflection pivoting said axle relative to said longitudinal center line.

15. The combination according to claim 14 wherein said wheel and axle means receiving member includes a second flange and said interconnecting means includes a web to provide a generally flexible hinge extending in a plane normally perpendicular to the plane of said lower flange.

16. The combination according to claim 15 wherein said wheel and axle receiving member is interconnected with said second flange.

* * * * *